US010952587B2

(12) United States Patent
Sgroi, Jr. et al.

(10) Patent No.: US 10,952,587 B2
(45) Date of Patent: Mar. 23, 2021

(54) DUSTING DEVICES

(75) Inventors: Anthony Sgroi, Jr., Wallingford, CT (US); Dane Unger, Brookfield, CT (US); David Quinlan, Plantsville, CT (US); Jennifer Carter, Oxford, CT (US); Lindita Ajro, Oakville, CT (US); Paul Adams, Monroe, CT (US); Scott E. Machado, West Haven, CT (US); Bruce Popek, South Windsor, CT (US); Craig Bures, Prospect, CT (US); Douglas F. Melville, Simsbury, CT (US); James Dahl, Manchester, CT (US); Richard Andrus, Monterey, MA (US)

(73) Assignee: UNGER MARKETING INTERNATIONAL, LLC, Bridgeport, CT (US)

( * ) Notice: Subject to any disclaimer, the term of this patent is extended or adjusted under 35 U.S.C. 154(b) by 949 days.

(21) Appl. No.: 13/088,838

(22) Filed: Apr. 18, 2011

(65) Prior Publication Data

US 2011/0289711 A1 Dec. 1, 2011

Related U.S. Application Data

(60) Provisional application No. 61/325,131, filed on Apr. 16, 2010.

(51) Int. Cl.
*A47L 13/38* (2006.01)

(52) U.S. Cl.
CPC ..... *A47L 13/38* (2013.01); *Y10T 156/1052* (2015.01)

(58) Field of Classification Search
CPC ..... A47L 13/38; A47L 13/00; A47L 13/10; A47L 13/252–253; A47L 13/255; A47L 13/258; B32B 7/08; B29C 70/20
USPC ..... 15/209.1, 210.1, 229.1–229.9; 156/93, 156/250
See application file for complete search history.

(56) References Cited

U.S. PATENT DOCUMENTS

| | | | | |
|---|---|---|---|---|
| 56,018 | A * | 7/1866 | Dietz | 15/234 |
| 4,227,278 | A * | 10/1980 | Raskin | A47L 13/38 15/184 |
| D284,126 | S | 6/1986 | Landwehrmann | |
| 5,313,909 | A | 5/1994 | Tseng | |
| 6,237,184 | B1 | 5/2001 | Lenaghan | |
| 6,802,104 | B1 * | 10/2004 | Redd | A47L 9/0613 15/393 |
| 7,356,869 | B2 | 4/2008 | Knopow et al. | |

(Continued)

FOREIGN PATENT DOCUMENTS

CN ZL 200620139883.5 11/2007

OTHER PUBLICATIONS

Office Action in co-pending U.S. Appl. No. 13/750,553 dated Apr. 25, 2013.

(Continued)

*Primary Examiner* — Weilun Lo
(74) *Attorney, Agent, or Firm* — Cantor Colburn LLP

(57) ABSTRACT

A dusting device is provided that has at least one cleaning member with a microfiber bundle secured to a spine by a seam. The spine provides a resilient flexibility to the cleaning member such that the spine flexes as pressure is applied, but at least partially returns to an original shape upon removal of the pressure.

20 Claims, 23 Drawing Sheets

(56) References Cited

U.S. PATENT DOCUMENTS

| | | | | |
|---|---|---|---|---|
| D589,221 | S | 3/2009 | Wada et al. | |
| D610,320 | S | 2/2010 | Wada et al. | |
| 8,046,865 | B2 * | 11/2011 | Knopow | A46B 5/0075 15/209.1 |
| D671,700 | S | 11/2012 | Patterson | |
| D685,152 | S | 6/2013 | Smith | |
| D698,110 | S | 1/2014 | Wanger et al. | |
| 2006/0123575 | A1 | 6/2006 | Maloney | |
| 2006/0191089 | A1 * | 8/2006 | Gracindo | A46B 7/023 15/144.4 |
| 2007/0084006 | A1 * | 4/2007 | Policicchio | A47L 13/16 15/226 |
| 2008/0148508 | A1 * | 6/2008 | Yamada | A47L 13/16 15/229.3 |
| 2010/0154156 | A1 * | 6/2010 | Takabayashi et al. | 15/209.1 |
| 2010/0178846 | A1 * | 7/2010 | Brooker | 450/1 |
| 2010/0287721 | A1 | 11/2010 | Lewis | |
| 2011/0088189 | A1 * | 4/2011 | Wada | A47L 13/20 15/209.1 |
| 2012/0255133 | A1 * | 10/2012 | Zita | A47L 7/0057 15/1.52 |
| 2013/0133150 | A1 * | 5/2013 | Sgroi et al. | 15/209.1 |

OTHER PUBLICATIONS

Amendment filed Jul. 25, 2013 in co-pending U.S. Appl. No. 13/750,553 in response to the Office Action dated Apr. 25, 2013.

Office Action dated Nov. 20, 2013 in corresponding U.S. Appl. No. 13/750,553.

Response dated Feb. 20, 2014 in corresponding U.S. Appl. No. 13/750,553.

Advisory Action dated Apr. 2, 2014 in corresponding U.S. Appl. No. 13/750,553.

Office Action dated Feb. 27, 2015 in corresponding U.S. Appl. No. 13/750,553.

Response dated Jul. 24, 2015 in corresponding U.S. Appl. No. 13/750,553.

* cited by examiner

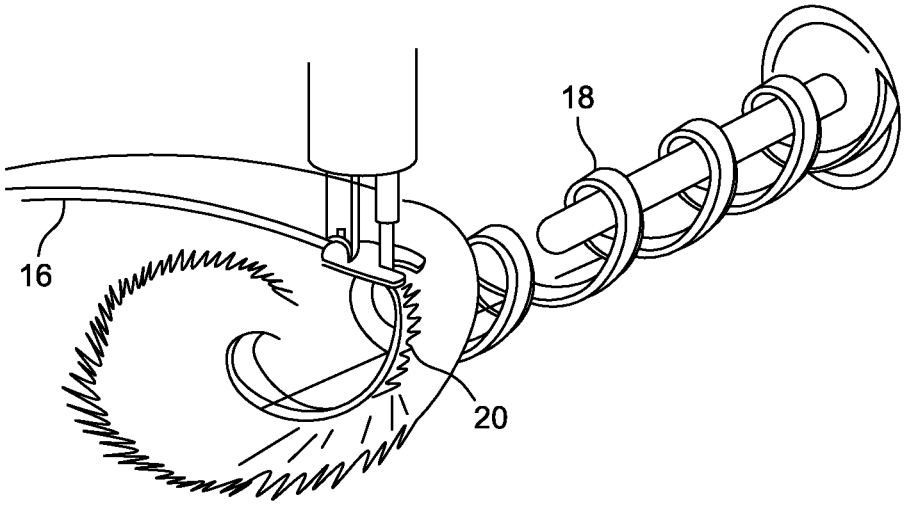
FIG. 9A
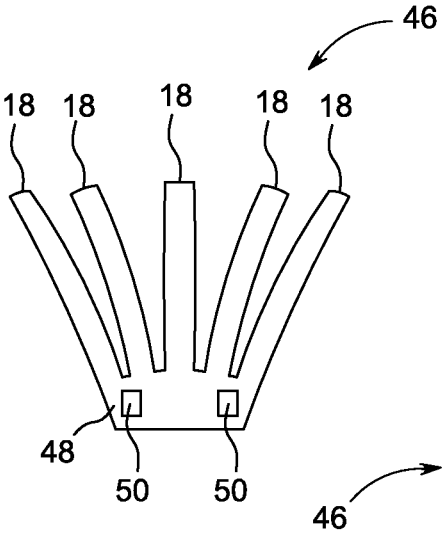
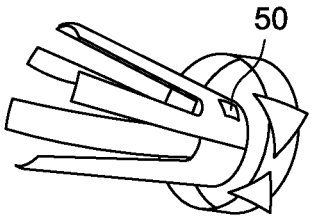
FIG. 10A
FIG. 10B

DUSTING DEVICES

CROSS REFERENCE TO RELATED APPLICATIONS

This application claims the benefit of U.S. Provisional Application Ser. No. 61/325,131, filed Apr. 16, 2010, the contents of which are incorporated by reference herein.

BACKGROUND OF THE INVENTION

1. Field of the Invention

The present disclosure is related to dusting devices. More particularly, the present disclosure is related to dusting devices with cleaning members that are flexible, washable, and reusable.

2. Description of Related Art

The recurring need to remove dust from various surfaces in residential and/or commercial settings has led to a variety of hand held dusting devices being developed to accomplish this task. Some common prior art hand held dusting devices range from simple devices, such as a dusting rag, to more elaborate devices such as hand held feather dusters. Each of these prior art hand held dusting devices provide different advantages and/or disadvantages to the user.

More recently, hand held dusting devices consisting of a handle with a cleaning pad removably secured thereon have been introduced. In many examples, the removable cleaning pad is made of non-woven polymeric materials. When using these prior art devices, the non-woven polymeric cleaning pads, once soiled, must be removed from the handle and replaced with a new cleaning pad. The cost and/or perceived environmental impact of constantly replacing the non-woven cleaning pad may reduce the appeal of such hand held dusting devices to some consumers.

Accordingly, it has been determined by the present disclosure that there is a need for hand held dusting devices that overcome, alleviate, and/or mitigate one or more of the aforementioned and other deleterious effects of the prior art.

BRIEF SUMMARY OF THE INVENTION

A hand held dusting device is provided that includes a flexible spine with a washable and reusable cleaning member permanently secured thereon. The cleaning member is comprised of a microfiber bundle, which when combined with the spine allow the dusting device to function in a similar, but improved, manner as common feather dusters. Thus, the microfiber bundle and spine combine to form a flexible, washable, and reusable "microfiber feather", which provides the dusting device of the present application with the enhanced dust collection functionality of typical microfiber fabrics.

A dusting device is provided that has at least one cleaning member with a microfiber bundle secured to a spine by a seam. The spine provides a resilient flexibility to the cleaning member such that the spine flexes as pressure is applied, but at least partially returns to an original shape upon removal of the pressure.

A method of forming a flexible, washable cleaning member for a dusting device is also provided. The method includes bonding a length of microfiber to itself by a first seam; trimming the microfiber to divide the length of microfiber into a plurality of segments secured together by the seam to define a microfiber bundle; fluffing the microfiber bundle to provide loft and separation between the plurality of segments; and securing the microfiber bundle to a flexible spine by a second seam.

The above-described and other features and advantages of the present disclosure will be appreciated and understood by those skilled in the art from the following detailed description, drawings, and appended claims.

BRIEF DESCRIPTION OF THE SEVERAL VIEWS OF THE DRAWINGS

FIG. 9A is a first exemplary embodiment of a spine according to the present disclosure during assembly of a microfiber bundle with the spine;

FIGS. 10A and 10B are views of a third exemplary embodiment of a spine according to the present disclosure;

DETAILED DESCRIPTION OF THE INVENTION

Figure 1:
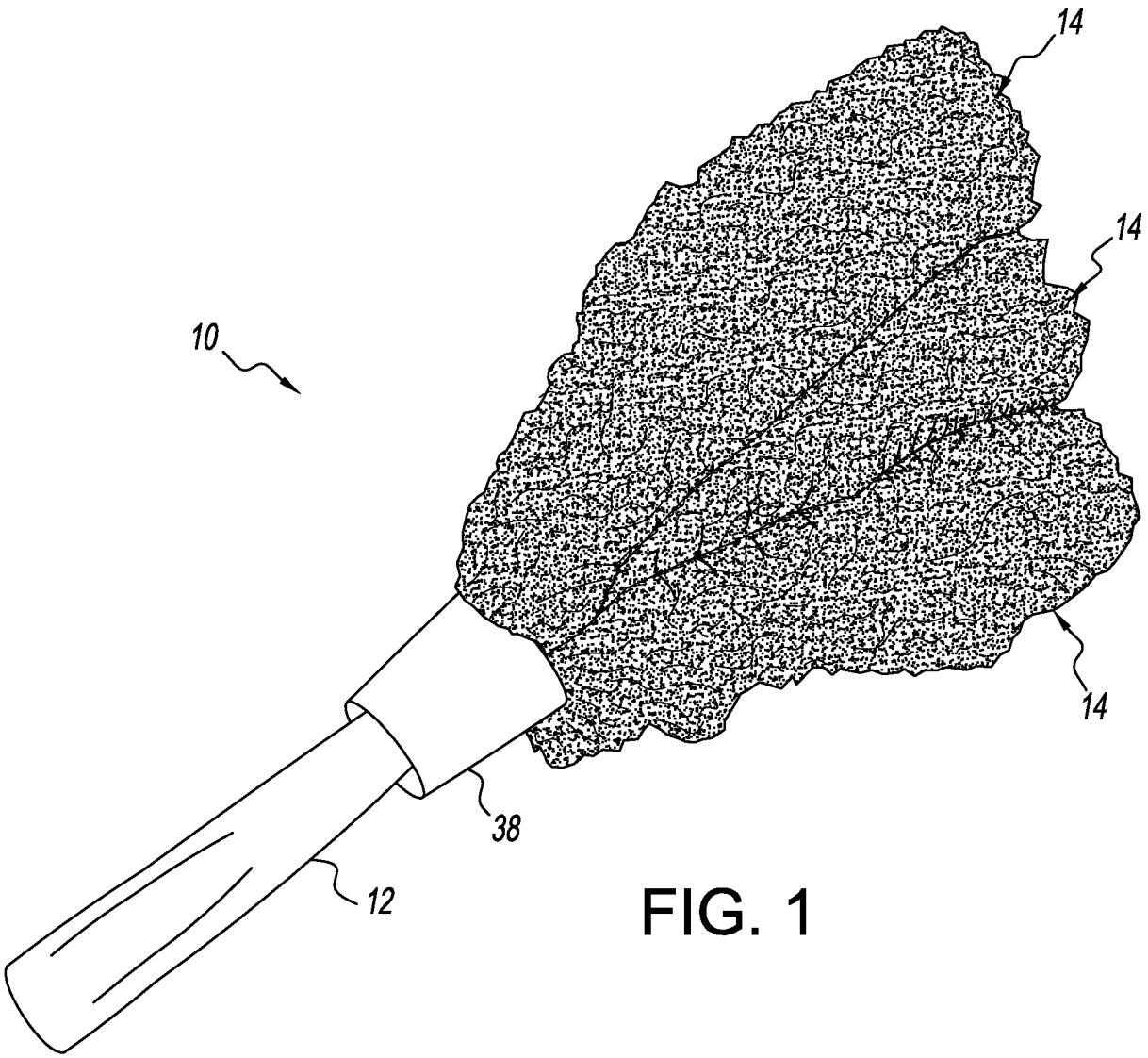
FIG. 1 is a perspective view of an exemplary embodiment of a hand held dusting device according to the present disclosure.

Referring to the drawings and in particular to FIG. 1, an exemplary embodiment of a dusting device according to the present disclosure is shown and is generally referred to by reference numeral 10. Dusting device 10 includes a handle 12 and one or more flexible, washable, and reusable cleaning members 14 (three shown).

Figure 2:
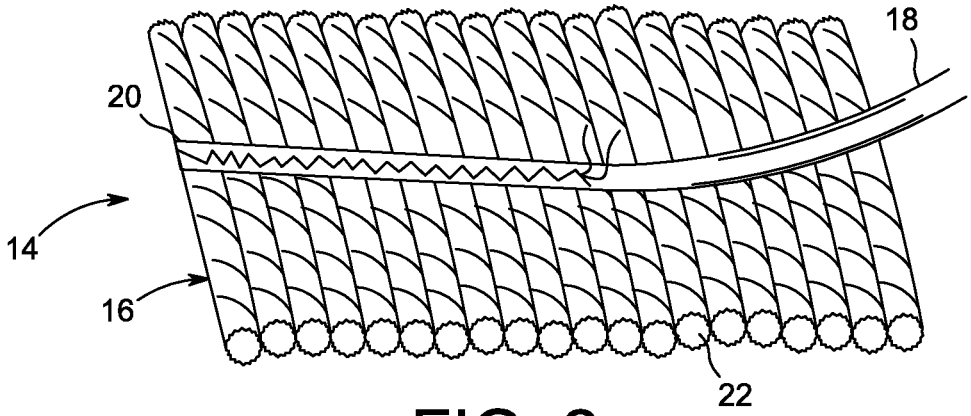
FIG. 2 is a perspective view of an exemplary embodiment of a washable and reusable cleaning member according to the present disclosure during assembly of a microfiber bundle with a spine.
Figure 3:
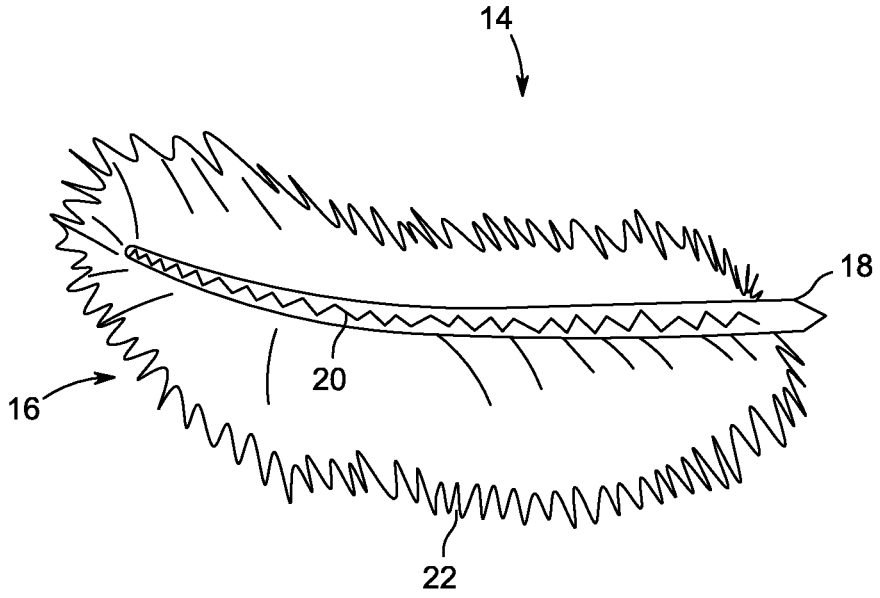
FIG. 3 is a perspective view of the washable and reusable cleaning member of FIG. 2 after assembly of the microfiber bundle with the spine.
Figure 4A:
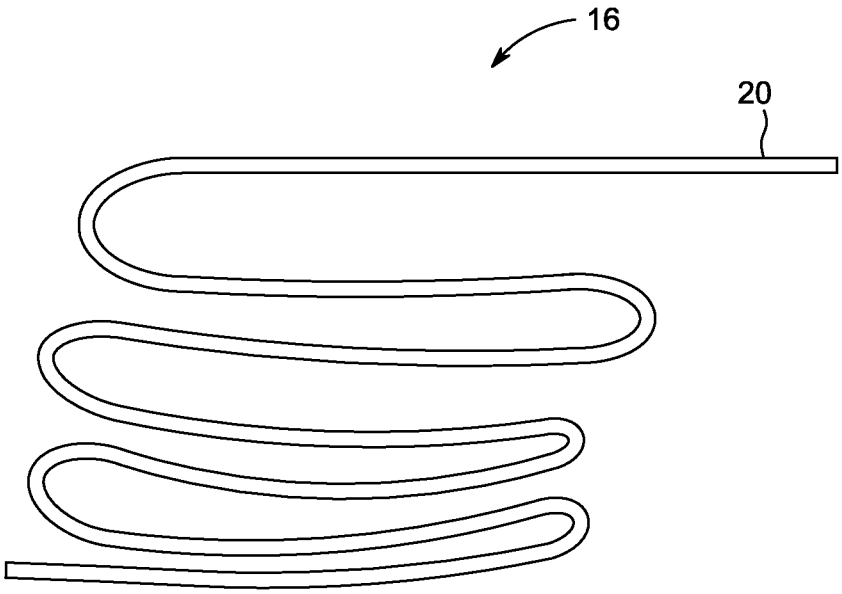
FIG. 4A is a side view of a first exemplary embodiment of a fiber layout for the microfiber bundle of FIG. 2.

Cleaning member 14, also referred to herein as a "microfiber feather", is an assembly of a microfiber bundle 16 with a flexible spine 18 as shown in FIGS. 2 and 3. Bundle 16 is shown in FIG. 2 in a flattened state, and in FIG. 3 in a fluffed or spread state. Preferably, bundle 16 and spine 18 are permanently secured to one another by a seam 20.

As used herein, the term "seam" shall mean any continuous or non-continuous connection between microfiber bundle 16 and flexible spine 18. Seam 20 can be a sewn seam, a glued seam, a welded seam, woven seam, and any combinations thereof.

Bundle 16 is formed of a fiber 22, which is cut into a plurality of segments. In a preferred embodiment, fiber 22 is a microfiber. As used herein, the term "microfiber" shall mean a fiber having a denier of less than one. In some embodiments, fiber 22, when the fiber is a microfiber, is made of a blend of about 75% polyester (PE) and about 25% polyamide (PA) having a denier of about 0.138.

Spine 18 is configured to provide a resilient flexibility to cleaning member 14. Namely, spine 18 bends as pressure is applied during dusting, but at least partially returns to its original shape upon removal of the pressure. Additionally, spine 18 is preferably made of a non-scratch material so that cleaning member 14 can be used on a variety of delicate surfaces. For example, it is contemplated by the present disclosure for spine 18 to be made of nylon, polyethylene, polypropylene, thermoplastic elastomer (TPE), thermoplastic rubber (TPR), silicone rubber, hard durameter rubbers, foam, acetal, and can be fabricated by any suitable method such as, but not limited to, injection molding, compression molding, die cutting, and others. It is also contemplated by the present disclosure for spine 18 to be formed of metallic materials such as spring steel or a core of twisted wire (e.g. pipe cleaner material). Of course, any material or combinations thereof that provide the desired flexibility, washability, and non-scratchability are sufficient.

Spine 18 can have any desired cross section that are sufficient to provide the desired flexibility, washability, and non-scratchability. For example, spine 18 can have a substantially polygonal cross section including triangular, rectangular, or as many sides as desired, a substantially circular or ovoid cross section, a star shaped cross-section having a core with a plurality of evenly spaced or unevenly spaced radially extending members, and any combinations thereof.

Advantageously, cleaning member 14 is flexible, washable, and reusable. As used herein, the term "washable" shall mean that the microfiber feather, and when necessary other components of the dusting device, can be washed in a cleaning solution such as water and/or detergent either by hand or in a washing machine such as, a laundry washing machine and a laundry drying machine.

Bundle 16 is described with simultaneous reference to FIGS. 4 through 8. FIGS. 4A through 4C illustrate a first embodiment for constructing bundle 16. During the construction of bundle 16, a length of microfiber 22 is repeatedly folded upon itself to a desired length 24 and a desired width 26.

It should be recognized that bundle 16 is described by way of example only as being constructed with microfiber 22 folded to a single, constant width 26 along length 24. Of course, it is contemplated by the present disclosure for bundle 16 to be constructed with width 26 that varies along length 24. It should also be recognized that bundle 16 is described by way of example only as being constructed with microfiber 22 folded so that width 26 is symmetrical about a central axis 28 of the bundle. Of course, it is contemplated by the present disclosure for bundle 16 to be constructed with width 26 that is non-symmetrical about central axis 28.

Once folded to the desired length 24, the various portions of microfiber 22 in bundle 16 are joined by a seam 30. In the illustrated embodiment, seam 30 is defined along central axis 28. Of course, it is contemplated by the present disclosure for seam 30 to be defined in any desired position on bundle 16. One having ordinary skill in the art can appreciate that the various portions of fiber 22 of bundle 16 and seam 20 can be fabricated by a continuous feeding process. That is, seam 20 can join the various portions of fiber 22 as the length of the fiber is repeatedly folded upon itself. This allows bundle 16 the option of being cut to any desired length 24.

Once secured together by seam 30, loops 32, which are formed by the folds of fiber 22, are cut so that the microfiber is divided into a plurality of segments 34. Thus, in FIG. 4B, the loops 32 of bundle 16 are cut at both sides (i.e., two cuts are made) to provide the bundle shown in FIG. 4C. Segments 34 preferably have a length of about 46.5 millimeters (mm), which has been determined by the present disclosure as being sufficient to allow cleaning member 14 to be washable. However, without being bound to a particular theory, segment 34 can have any length sufficient so that the segments of bundle 16 resist tangling during the machine wash and machine drying processes.

In some embodiments, bundle 16 can include one or more cut-guiding seams 36 (two shown on each side of axis 28). Cut-guiding seams 36 have been found by the present disclosure as being advantageous to maintain fiber 22 in a desired position to ensure that each loop 32 is cut. After cutting loops 32, cut-guiding seams 36 are removed so that segments 34 move freely about their connection at seam 30.

Figure 5A:
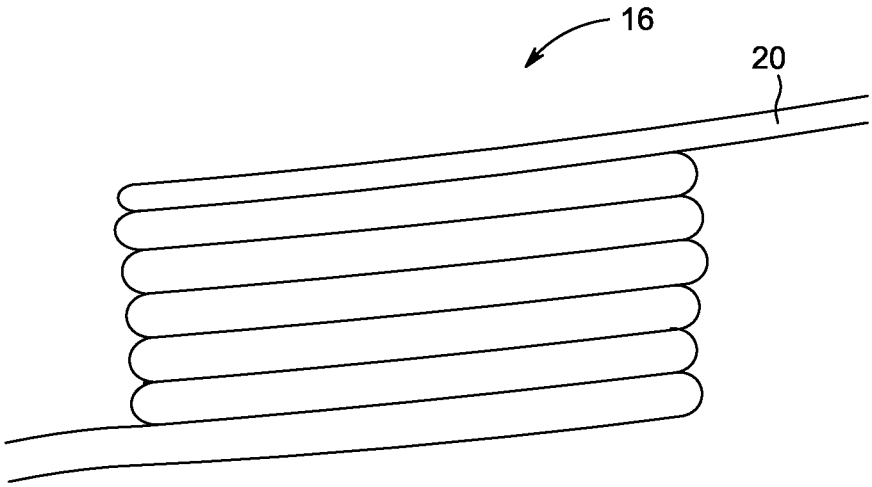
FIG. 5A is a side view of a second exemplary embodiment of a fiber layout for the microfiber bundle of FIG. 2.
Figure 4B:
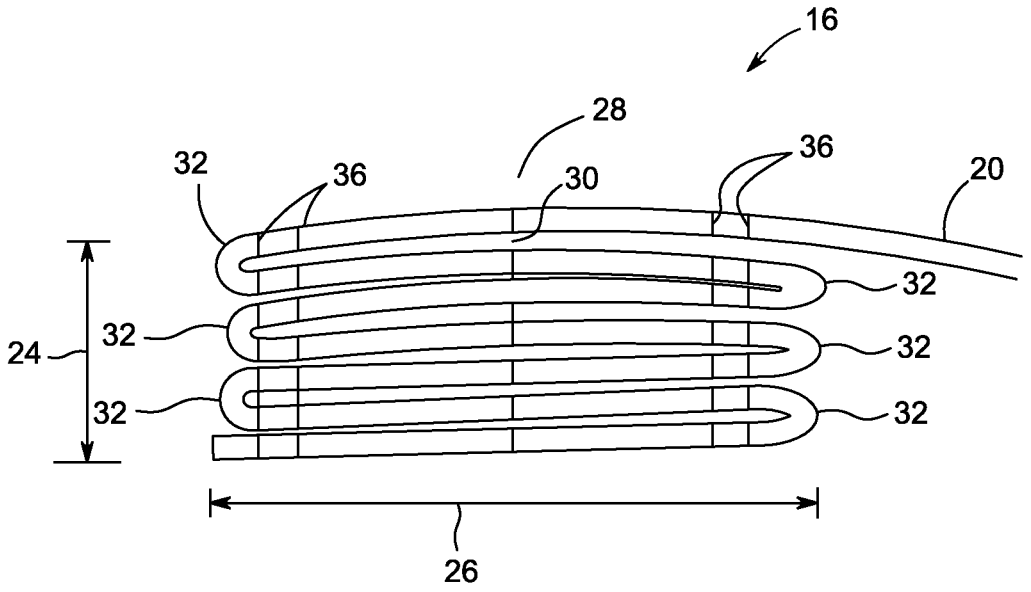
FIG. 4B is a side view of the fiber layout of FIG. 4A after joining with one or more seams.
Figure 5B:
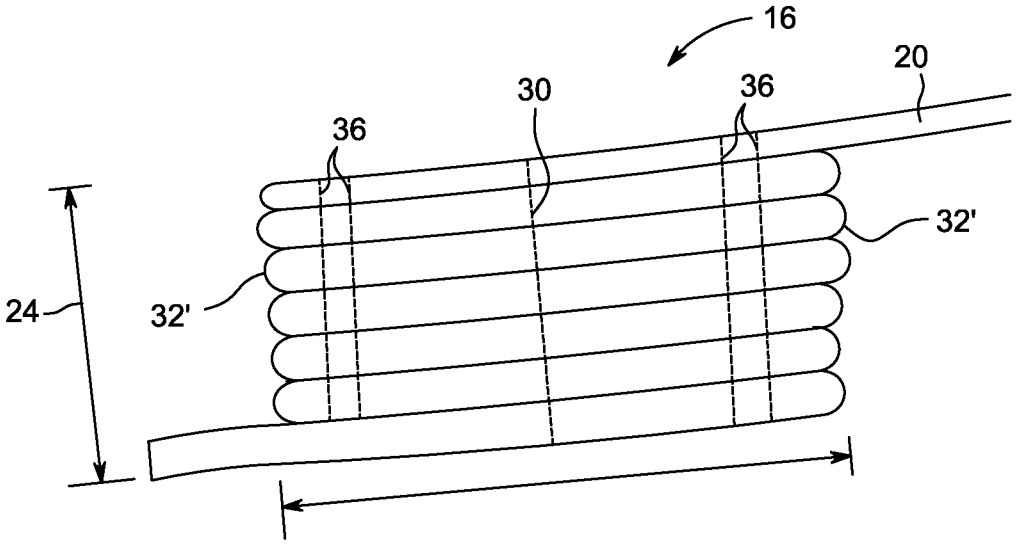
FIG. 5B is a side view of the fiber layout of FIG. 5A after joining with one or more seams.
Figure 4C:
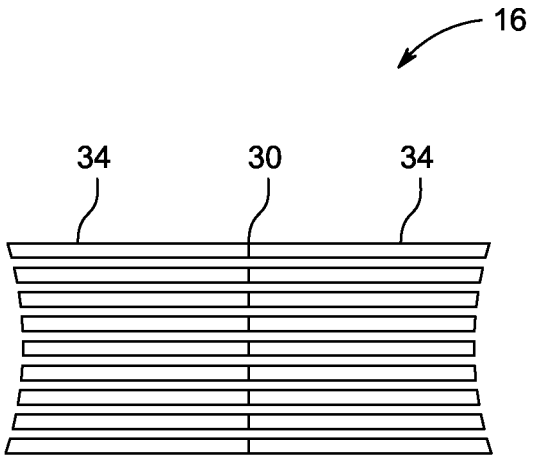
FIG. 4C is a side view of the fiber layout of FIG. 4B after cutting the microfiber into segments and removing the cut-guiding seams.
Figure 5C:
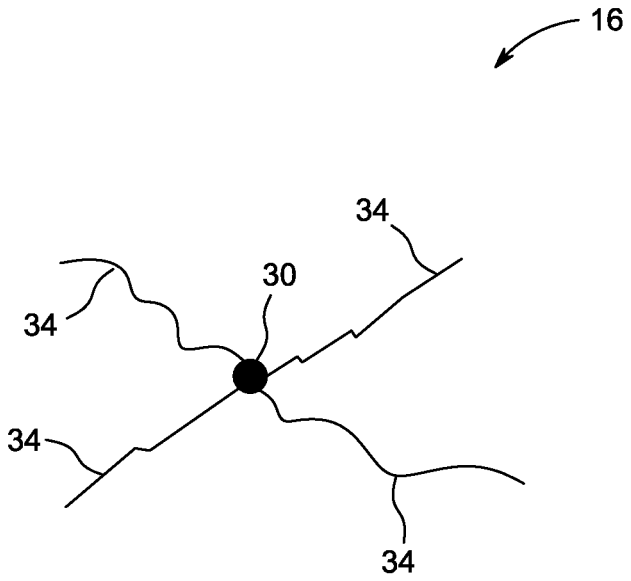
FIG. 5C is a side view of the fiber layout of FIG. 5B after cutting the microfiber into segments and removing the cut-guiding seams.

FIGS. 5A through 5C illustrate a second embodiment for constructing bundle 16. Here, during the construction of bundle 16, the length of fiber 22 is repeatedly coiled upon itself to desired length 24 and desired width 26.

It should be recognized that bundle 16 is described by way of example only as being constructed with fiber 22 coiled to a single, constant width 26 along length 24. Of course, it is contemplated by the present disclosure for bundle 16 to be constructed with width 26 that varies along length 24. It should also be recognized that bundle 16 is described by way of example only as being constructed with fiber 22 coiled so that width 26 is symmetrical about central axis 28 of the bundle. Of course, it is contemplated by the present disclosure for bundle 16 to be constructed with width 26 that is non-symmetrical about central axis 28.

Once coiled to the desired length 24, the various portions of fiber 22 in bundle 16 are joined by seam 30. In the illustrated embodiment, seam 30 is defined along central axis 28. Of course, it is contemplated by the present disclosure for seam 30 to be defined in any desired position on bundle 16 and can be formed by a continuous feeding process as detailed above.

Once secured together by seam 30, coils 32', which are formed by the repeated coiling of fiber 22, are cut so that the microfiber is divided into two different plurality of segments 34. Thus, in FIG. 5B, the coils 32' of bundle 16 are cut at both sides (i.e., two cuts are made) to provide the bundle shown in FIG. 5C. The cuts can have any desired shape such as, but not limited to, a straight line, a curved line, a sinosodial pattern, or any other shape.

In some embodiments, bundle 16 can include one or more cut-guiding seams 36 (two shown on each side of axis 28), which are removed after cutting so that segments 34 move freely about their connection at seam 30 as discussed above.

Figure 6A:
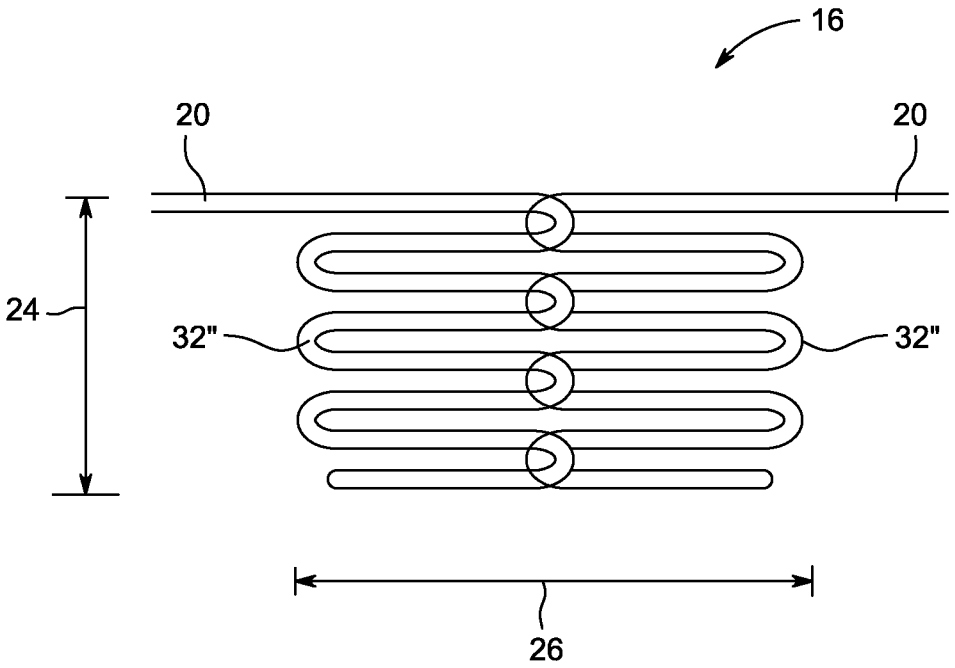
FIG. 6A is a side view of a third exemplary embodiment of a fiber layout for the microfiber bundle of FIG. 2.
Figure 6B:
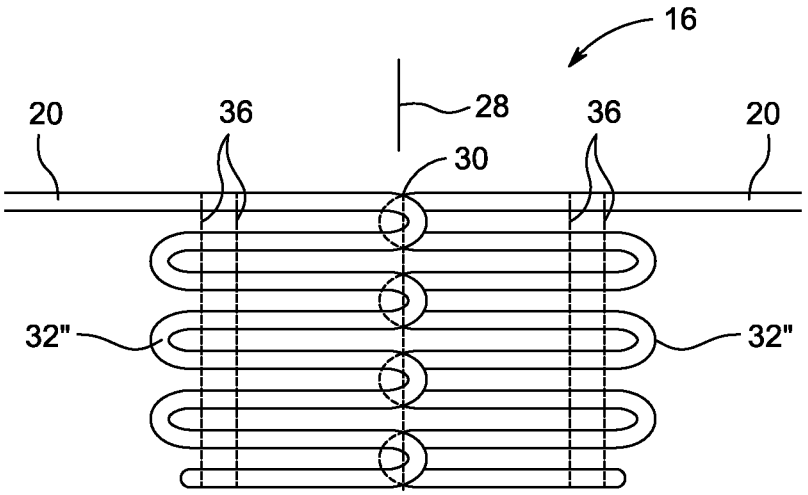
FIG. 6B is a side view of the fiber layout of FIG. 6A after joining with one or more seams.
Figure 6C:
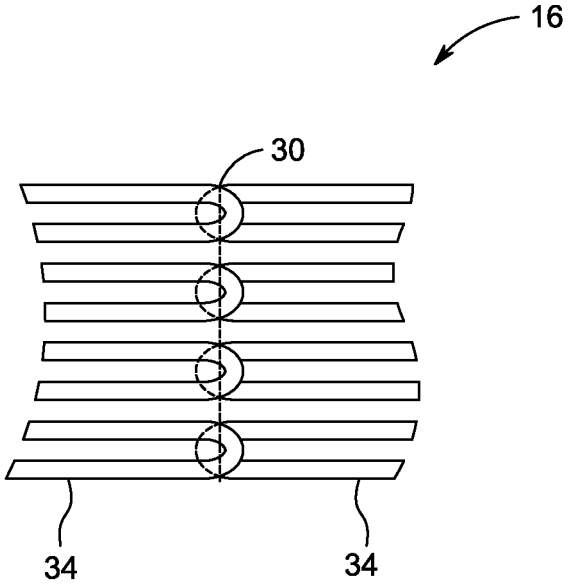
FIG. 6C is a side view of the fiber layout of FIG. 6B after cutting the microfiber into segments and removing the cut-guiding seams.

FIGS. 6A through 6C illustrate a third embodiment for constructing bundle 16. During the construction of bundle 16, two different lengths of fiber 22 are repeatedly folded upon themselves and are placed adjacent to one another, in a partially overlapping manner, so that the resultant bundle has desired length 24 and desired width 26.

Again, it should be recognized that bundle 16 is described by way of example only as being constructed with two microfibers 20 folded to a single, constant width 26 along length 24 and having the microfibers folded so that width 26 is symmetrical about a central axis 28 of the bundle. Of course, any desired configuration is contemplated by the present disclosure.

Once folded to the desired length 24, the various portions of microfibers 20 in bundle 16 are joined by a seam 30. In the illustrated embodiment, seam 30 is defined along central axis 28. Of course, it is contemplated by the present disclosure for seam 30 to be defined in any desired position on bundle 16 and can be formed by a continuous feeding process as detailed above.

Once secured together by seam 30, the outermost loops 32", which are formed by the folds of microfibers 20, are cut so that the two microfibers are divided into plurality of segments 34. Thus, in FIG. 6B, the outermost loops 32" of bundle 16 are cut at both sides (i.e., two cuts are made) to provide the bundle shown in FIG. 6C.

In some embodiments, bundle 16 can include one or more cut-guiding seams 36 (two shown on each side of axis 28). Cut-guiding seams 36 have been found by the present disclosure as being advantageous to maintain fiber 22 in a desired position to ensure that each outermost loop 32" is cut. After cutting loops 32", cut-guiding seams 36 are removed so that segments 34 move freely about their connection at seam 30. It should be noted that loops 32 can be cut between cut-guiding seams 36 so that one of the cut-guide seams remains with the cut loop, while the other of the cut-guiding seam remains on the segments for later removal. If desired, loops 32 can be cut on either side of cut-guiding seams 36.

In each embodiment of FIGS. 4 through 6, bundle 16 is made from one or more microfibers 20, bonded together by seam 30, then trimmed to divide the one or more microfibers into the plurality of segments 34. After trimming, bundle 16 can be further processed to provide loft and separation between the segments (e.g., fluffed).

Figure 7:
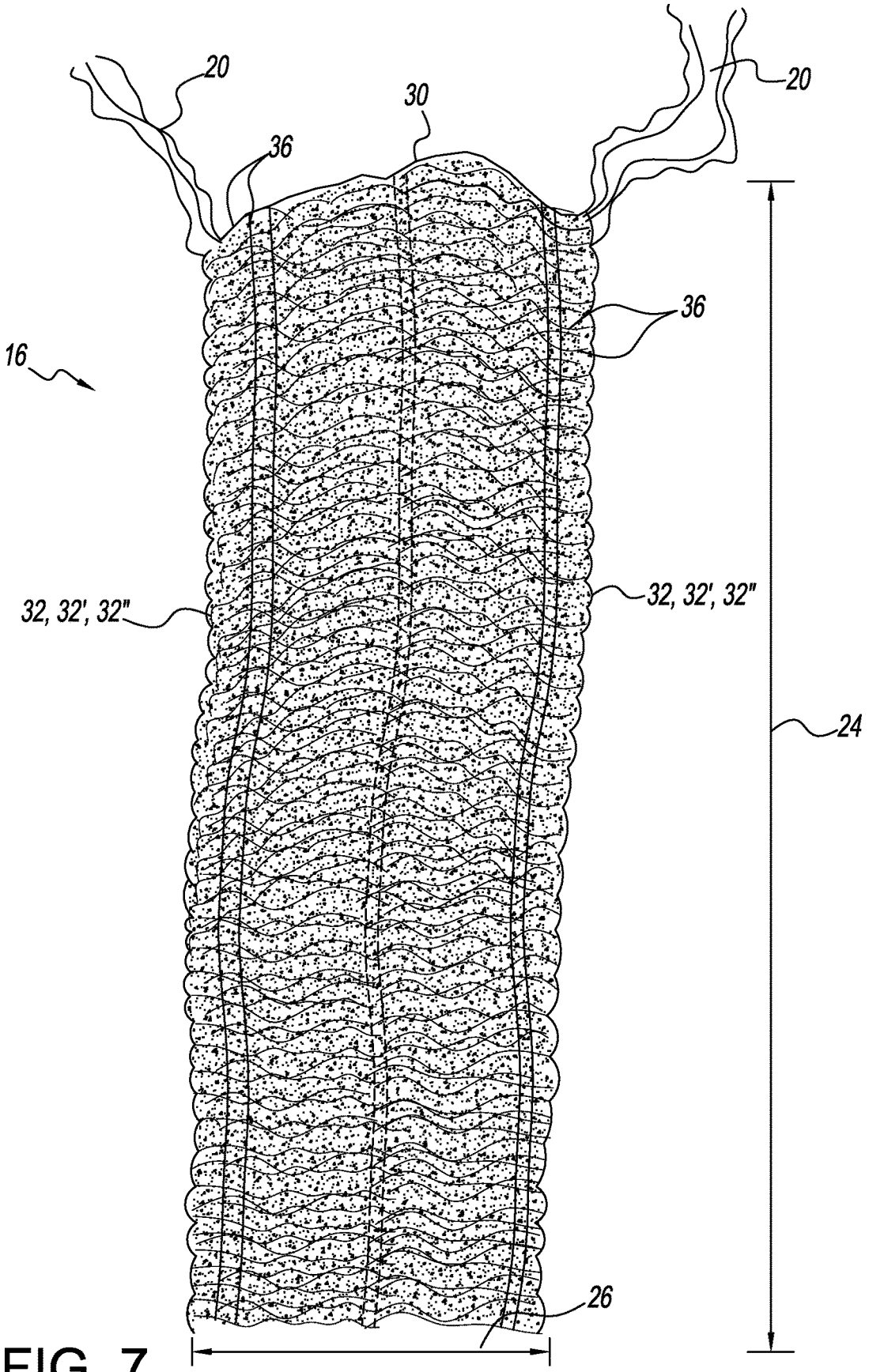
FIG. 7 is a top view of the microfiber bundle of FIG. 4, 5, or 6 before cutting loops of the fiber layout and removal of at least some of the seams.
Figure 8:
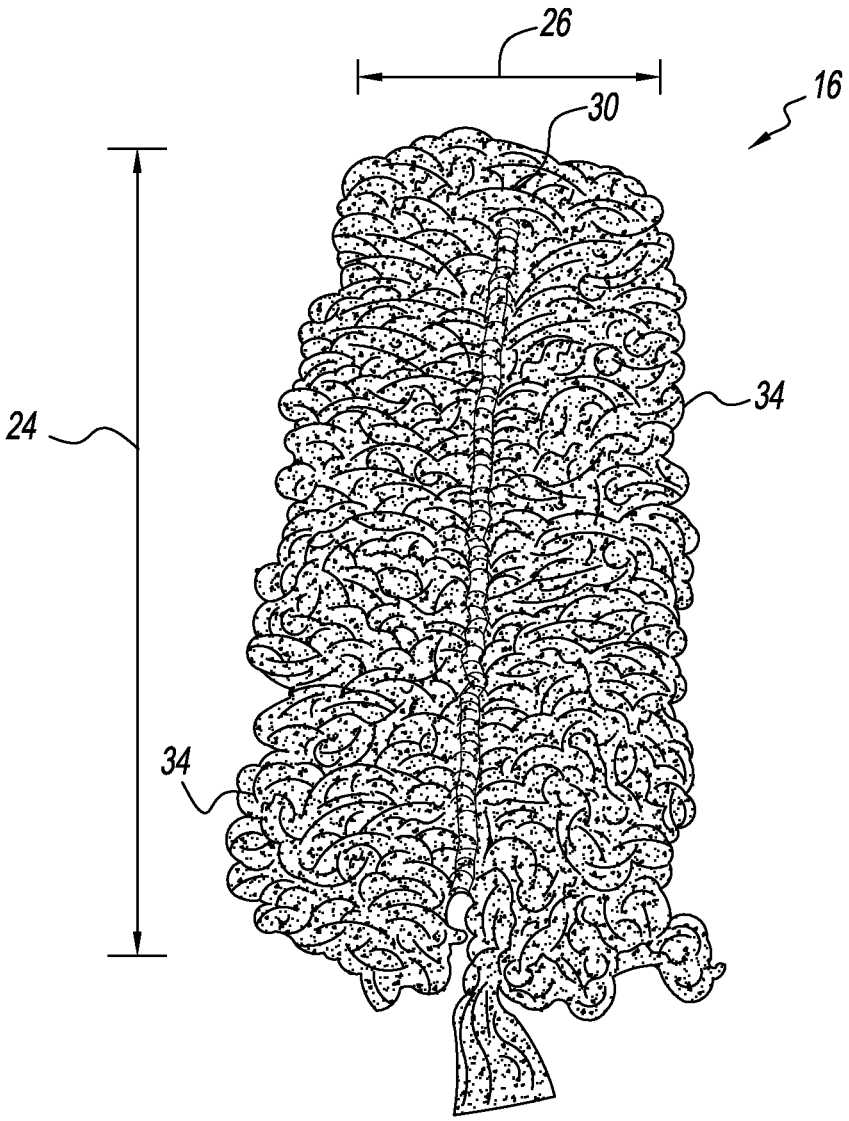
FIG. 8 is a top view of the microfiber bundle of FIG. 7 after cutting loops of the fiber layout and removal of at least some of the seams.

FIG. 7 illustrates bundle 16 having seam 30, loops 32, coils 32', or outermost loops 32", and cut-guiding seams 36 before cutting to provide segments 34. In contrast, FIG. 8 illustrates bundle 16 having seam 30, loops 32, coils 32', or outermost loops 32", after cutting to provide segments 34 and after the removal of cut-guiding seams 36, if provided.

Returning now to FIGS. 1 through 3, dusting device 10 is shown having five (three being visible) generally linear or straight cleaning members 14. In this embodiment, each cleaning member 14 has a generally narrow, flat spine 18 of substantially the same length connected to handle 12 by a connection device 38. However, it is contemplated by the present disclosure for cleaning members 14 to have any desired shape or length.

In some embodiments, handle 12 can be configured so that the entire dusting device 10 can be placed in the washing machine. However, it is also contemplated by the present disclosure for connection device 38 to removably connect cleaning members 14 to handle 12. In this manner, cleaning members 14 can be removed from handle 12 for washing and drying.

Figure 9C:
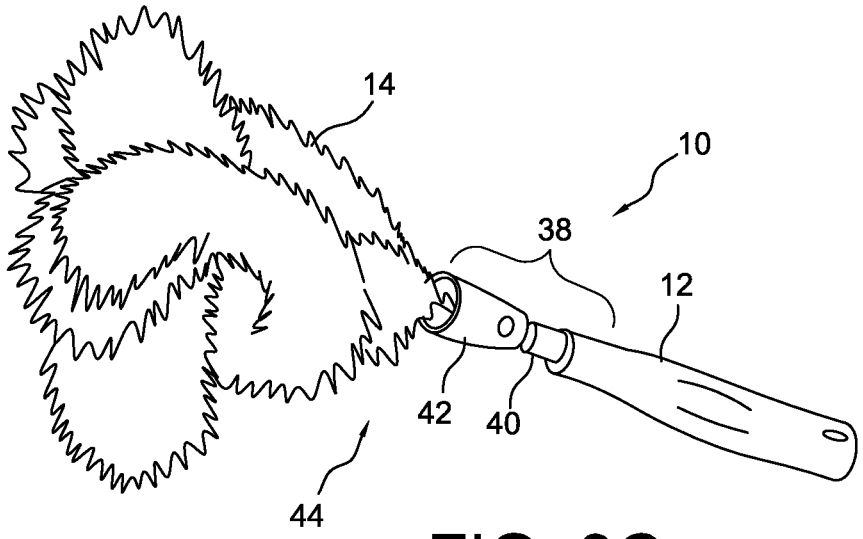
FIG. 9C is a perspective view of an exemplary embodiment of a dusting device according to the present disclosure having the spine of FIG. 9A or 9B.
Figure 9B:
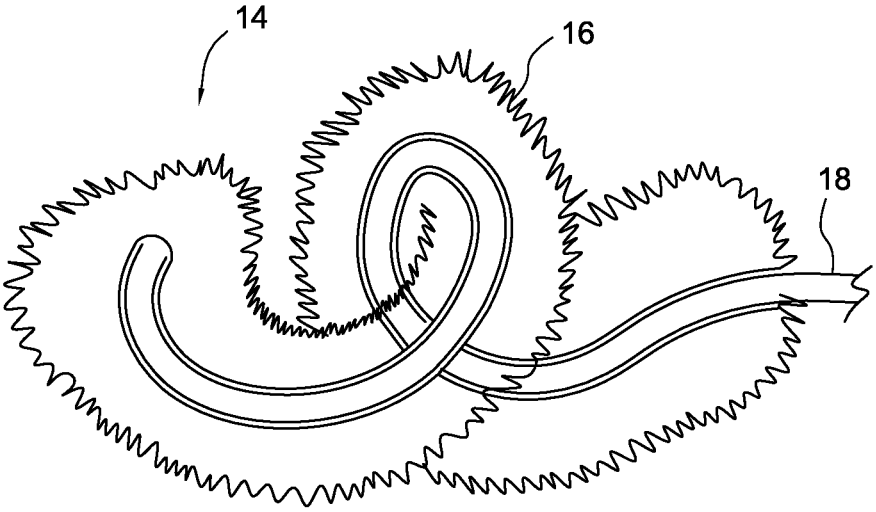
FIG. 9B is a second exemplary embodiment of a spine according to the present disclosure during assembly of a microfiber bundle with the spine.

In the embodiment shown in FIGS. 9A, 9B, and 9C, dusting device 10 is shown having three cleaning members 14 with a spine 18 of a generally elongated spiral shape. As shown, connection device 38 includes a first portion 40 on handle 12, and a second portion 42 that connects the cleaning members 14 to one another. Here, first and second portions 40, 42 are releasably secured to one another.

In some embodiments, second portion 42 maintains cleaning members 14 connected to one another such that a subassembly 44, consisting of the cleaning members and the second portion 42, can be removed from handle 12 for washing and drying. Thus, in this embodiment, at least cleaning members 14 and second portion 42 of dusting device 10 are washable. However, it should also be noted that cleaning members 14 can also be removed in individual manner (i.e. the ability of removing each cleaning member 14 seperately) to perform a washing/drying operation.

Figure 10C:
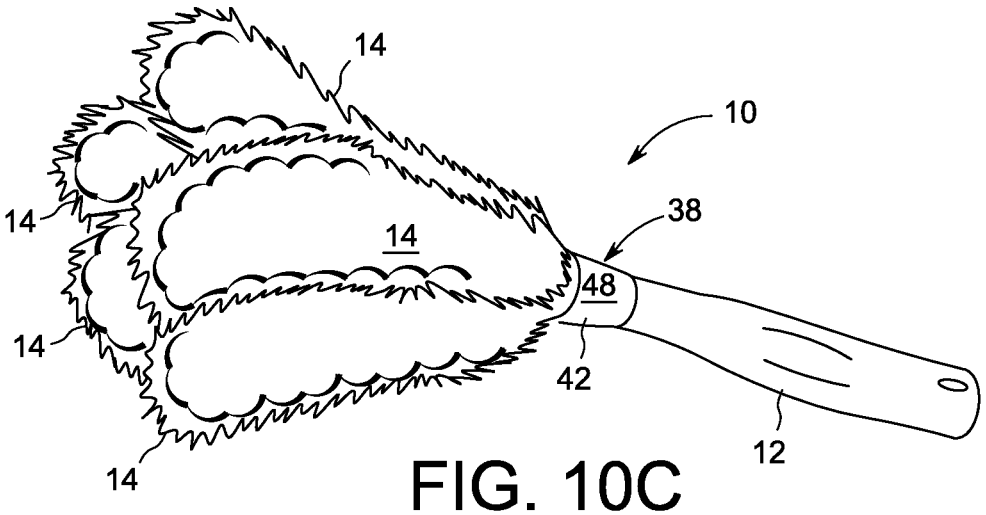
FIG. 10C is a perspective view of an exemplary embodiment of a dusting device according to the present disclosure having the spine of FIG. 10A or 10B.

Referring now to FIGS. 10A and 10B, it is contemplated by the present disclosure for a plurality of spines 18 to be integrally formed with one another to provide dusting device 10 with a desired shape such as that shown in FIG. 10C.

In this embodiment, spines 18 can be part of a spine assembly 46, which includes the spines joined with a base portion 48. Spine assembly 46 is shown in an open or non-use position in FIG. 10A, but in a closed or use position in FIG. 10B. In this embodiment, base portion 48 includes a pair of interlocking features 50, which releasably secure spine assembly 46 in the use position. It should be noted that interlocking features 50 can be any set of features configured to removably secure spine assembly 46 in the use position such as, but not limited to, welding, adhesive, and others. In other embodiments, spine assembly 46 can be integrally formed to the desired shape without the need for separate features 50.

Figure 10D:
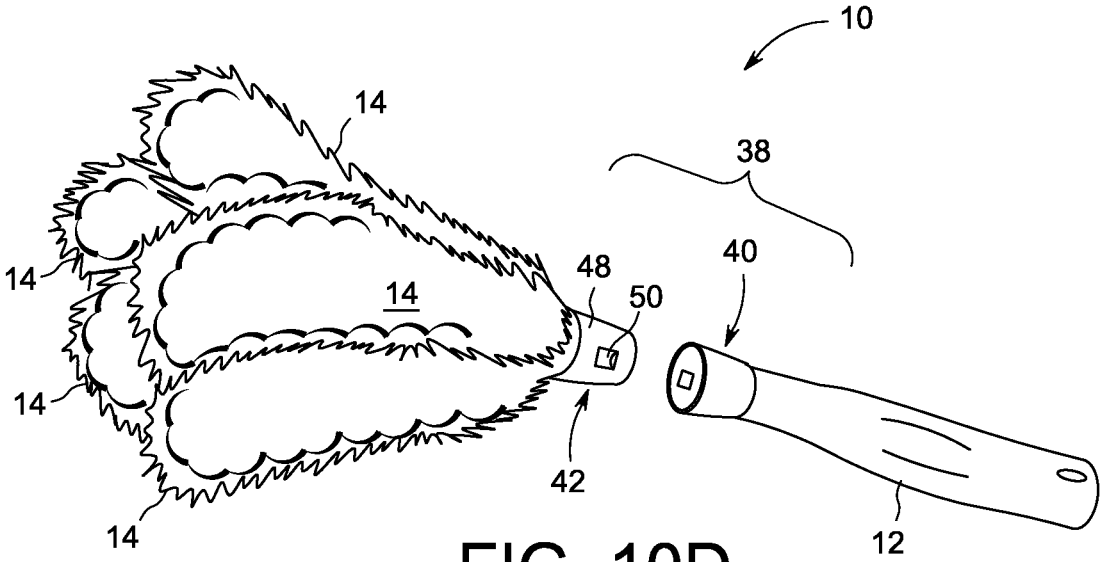
FIG. 10D is a partially exploded perspective view of an exemplary embodiment of the dusting device of FIG. 10C.

As shown in FIG. 10D, connection device 38 includes first portion 40 on handle 12, and second portion 42 that connects the cleaning members 14 to one another. Here, base portion 48 of spine assembly 46 also functions as second portion 42 of connection device 38. Additionally, interlocking features 50 can releasably mate with at least part of first portion 40 releasably secure the first portion to second portion 42. Of course any desired interlocking features 50 are contemplated by the present disclosure. For example, interlocking features 50 can be twistably secured and released from one another by way of threads or complementary pin and slot.

Figure 10E:
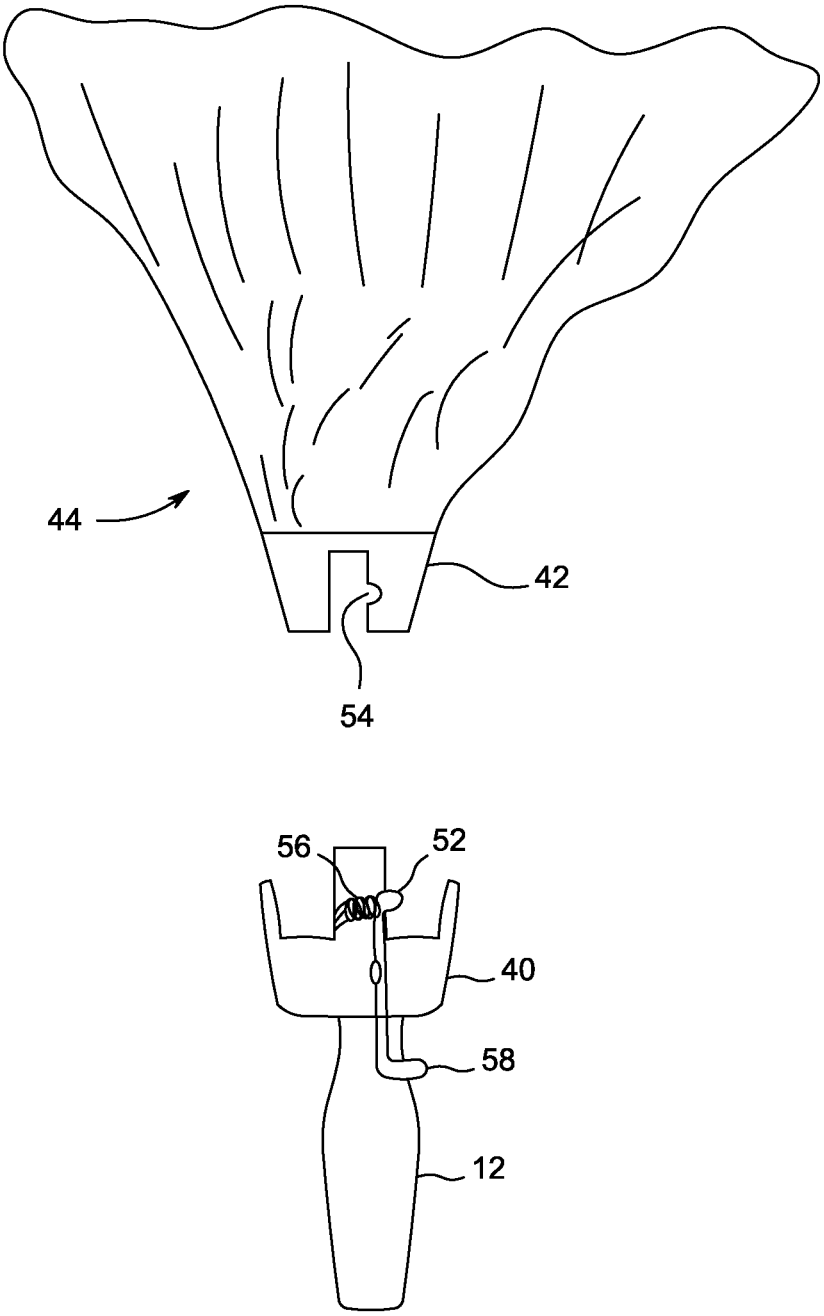
FIG. 10E is a partially exploded sectional view of another alternate exemplary embodiment of the dusting device of FIG. 10C.
Figure 10F:
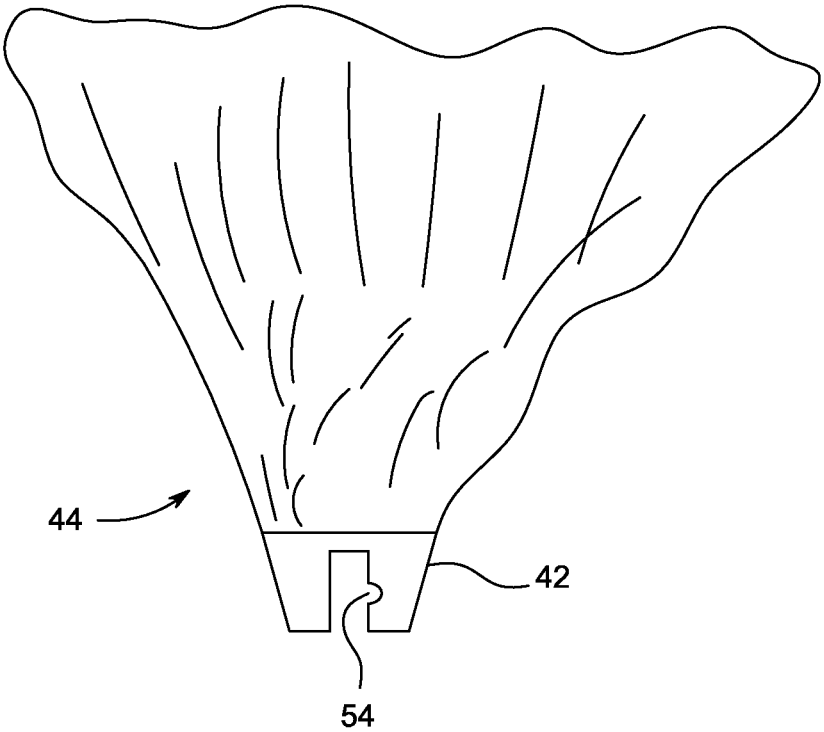
FIG. 10F is a partially exploded sectional view of yet another alternate exemplary embodiment of the dusting device of FIG. 10C.
Figure 10F:
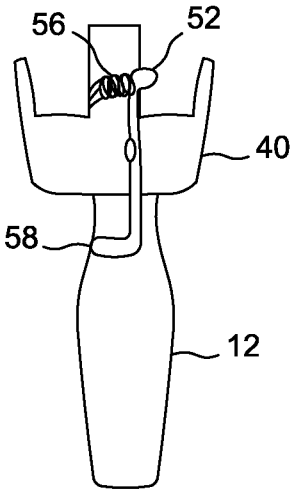

FIGS. 10E and 10F illustrate exemplary embodiments of connecting device 38 that releasably secure first portion 40 and second portion 42. In these embodiments, first portion 40 includes a feature 52 that releasably engages a corresponding feature 54 of second portion 42. Connecting device 38 includes a biasing member 56 and a button 58. Biasing member biases feature 52 to releasably engage corresponding feature 54, while button 58 can be actuated by the user to overcome the force of the biasing member to release feature 52 from the corresponding feature 54 to allow the user to remove subassembly 44.

Figure 11:
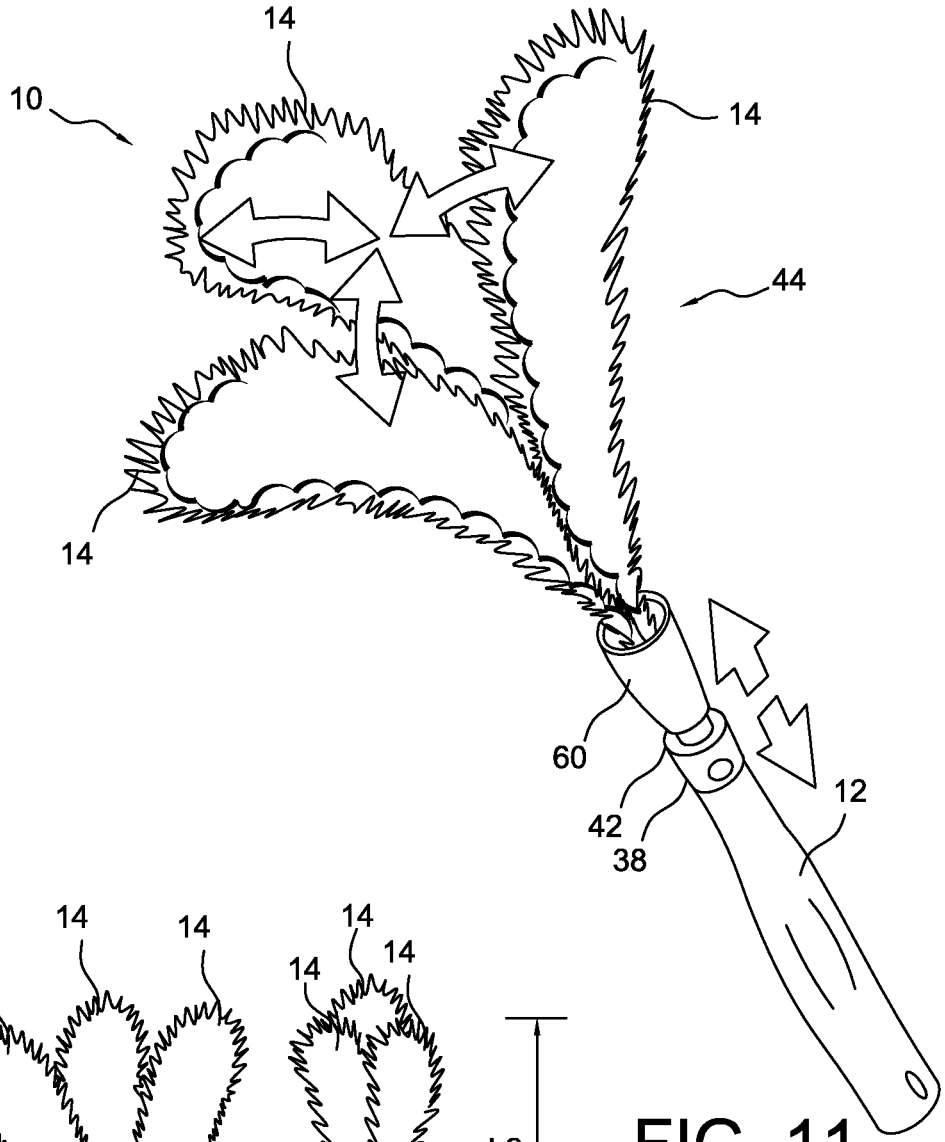
FIGS. 11, 12, and 13 are perspective views of another alternate exemplary embodiment of a dusting device according to the present disclosure, which includes a collection member.
Figure 12:
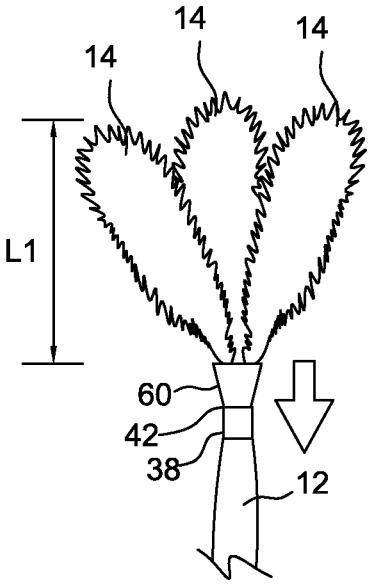
Figure 13:
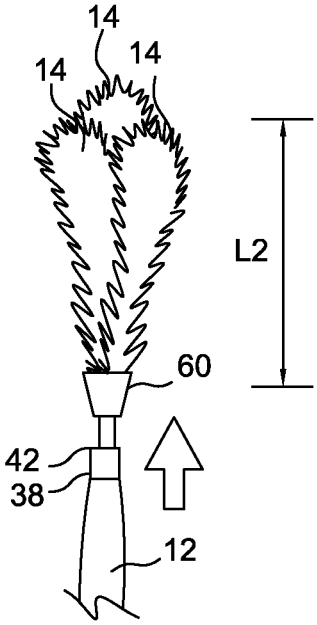

Referring now to FIGS. 11 through 13, dusting device 10 is shown with an exemplary embodiment of a span control member 60. Span control member 60 is slideably disposed over cleaning members 14 between a first position (FIGS. 11 and 12) and a second position (FIG. 13). As shown in FIGS. 11 and 12, cleaning members 14 are normally biased to a spread position so that the members span across a larger area to allow cleaning of larger surfaces. However in some instances, dusting device 10 may be too large to fit into a desired space when cleaning members 14 are spread to the full span. When span control member 60 is moved to second position of FIG. 13, the inner diameter of the control member restrains the cleaning members 14 from the full span.

Span control member 60 also serves as an adjustment of the flexible portion of spine 18 as detailed in FIGS. 12 and 13. As illustrated in FIG. 12, span control member 60 is in a position to maximize the length of spine 18 via a first dimension L1. When span control member 60 is moved away from handle 12, the active length of spine 18 is reduced to a second, smaller dimension L2 as in FIG. 13. Since in this example first dimension L1 is larger than second dimension L2, span control member 60 provides spine 18 with an increased stiffness in the position of FIG. 12 than in the position of FIG. 13.

Thus, when dusting delicate objects and more flexibility is desired, the user can adjust the stiffness of dusting device 10 by moving span control member 60 to the first dimension L1 as shown in FIG. 12. In contrast, when dusting other objections such as, but not limited to less fragile objects, less flexibility maybe desired. Here, the user can adjust the stiffness of dusting device 10 by moving span control member 60 to the second dimension L2 as shown in FIG. 13.

Furthermore, when it is desired to clean subassembly 44, the span control member 60 can be slid to second position of FIG. 13. In this position, cleaning members 14 are restrained from the full span by member 60 and are secured together at the bottom by second portion 42 of connecting device 38. It has been determined by the present disclosure that maintaining cleaning members 14 in the restrained position can mitigate damage to the subassembly 44, which otherwise might occur during typical machine washing and drying cycles. It should be recognized that the present disclosure provides span control member 60 for restraining cleaning members 14 to prevent damage during washing. Of course, the present disclosure contemplates the use of any span control member 60, which is configured to restrain cleaning members in place during washing. For example, span control member 60 can include a wash bag (not shown)_in which dusting device 10 is placed during washing.

Figure 14B:
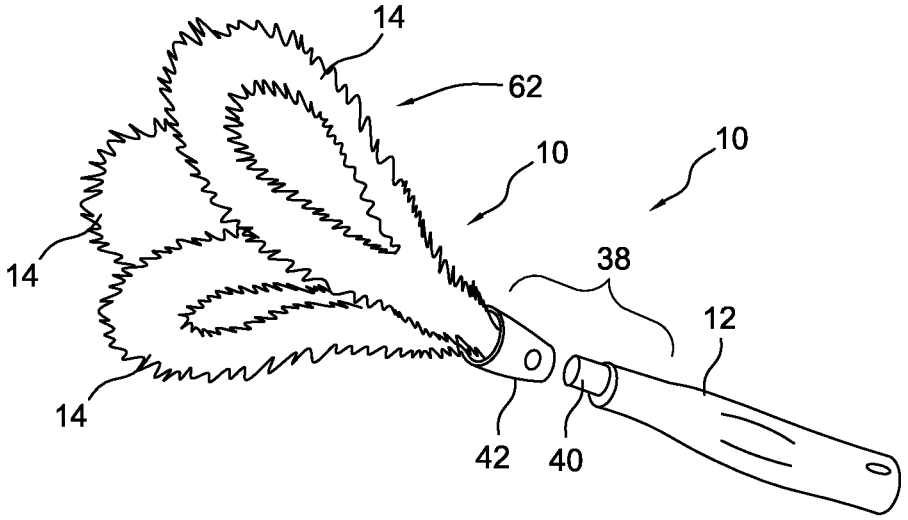
FIG. 14B is a perspective view of an exemplary embodiment of a dusting device according to the present disclosure having the spine of FIG. 14A.
Figure 14A:
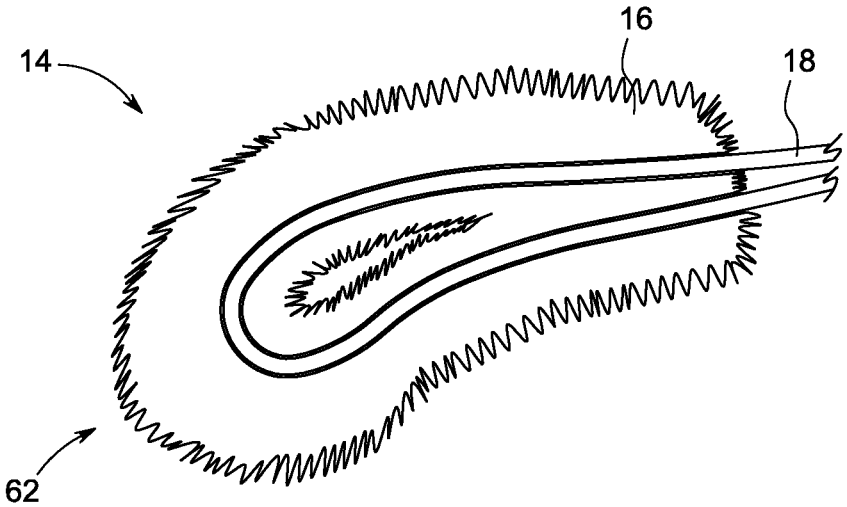
FIG. 14A is a perspective view of a fourth exemplary embodiment of a spine according to the present disclosure.

In the embodiment shown in FIGS. 14A and 14B, dusting device 10 is shown having cleaning members 14 with a spine 18 of a generally elongated looped shape 62. Looped shape 62 is formed by a bending spine 18. As shown, connection device 38 includes first and second portions 40, 42 that can be releasably secured to one another.

Figure 15B:
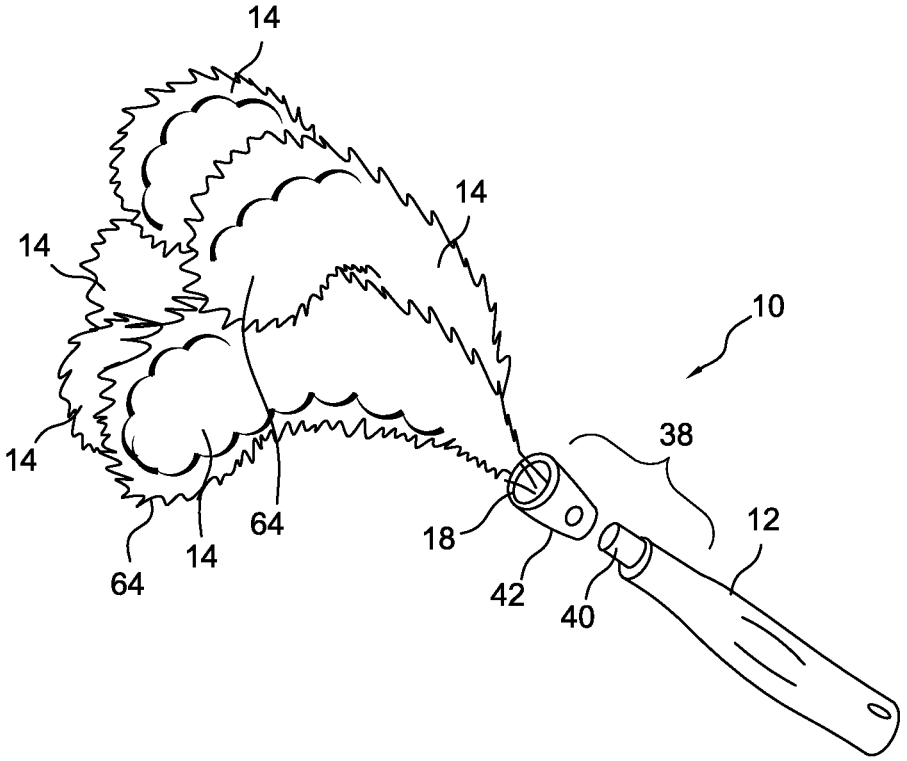
FIG. 15B is a perspective view of an exemplary embodiment of a dusting device according to the present disclosure having the spine of FIG. 15A.
Figure 15A:
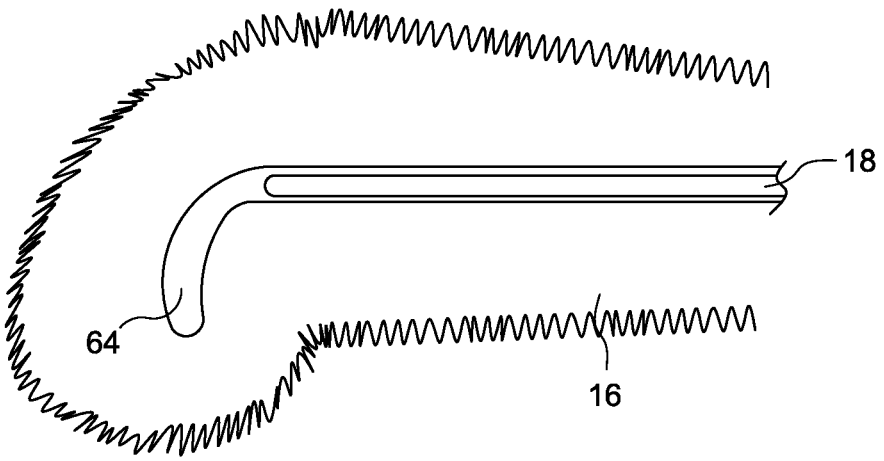
FIG. 15A is a perspective view of a fifth exemplary embodiment of a spine according to the present disclosure.

In the embodiment shown in FIGS. 15A and 15B, dusting device 10 is shown having cleaning members 14 with a spine 18 of a generally elongated straight shape. Here, bundle 16 is secured to spine 18 in such a manner so as to allow at least a portion 64 of the bundle unsupported by the spine. In other words, bundle 16 is longer than spine 18 so that portion 64 can move freely from the end of the spine. As shown, connection device 38 includes first and second portions 40, 42 that can be releasably secured to one another.

Figure 16A:
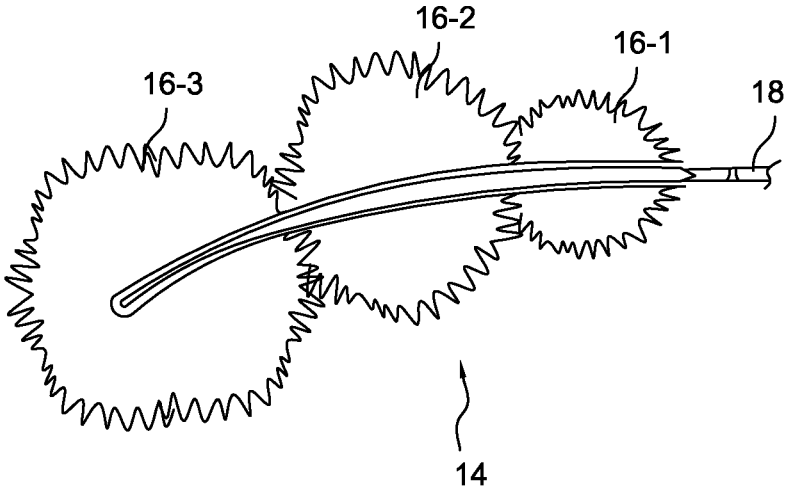
FIGS. 16A and 16B are views of other exemplary embodiments of spines according to the present disclosure.
Figure 16B:
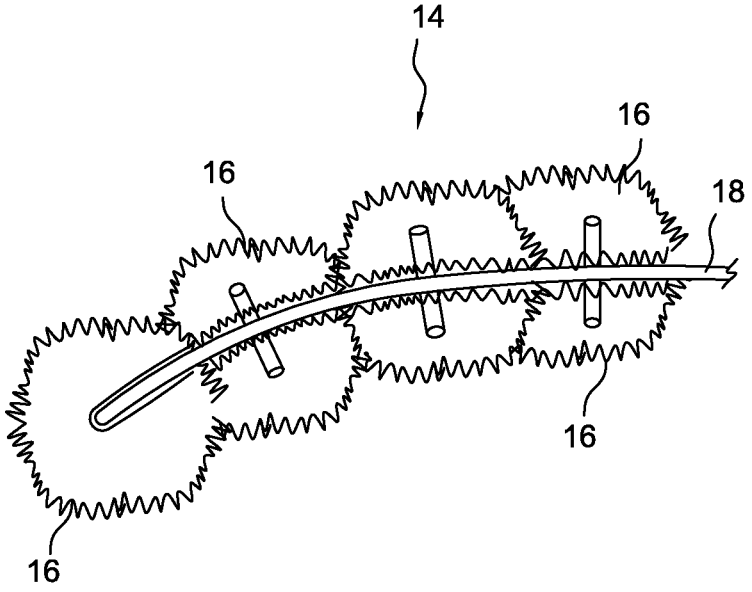
Figure 16C:
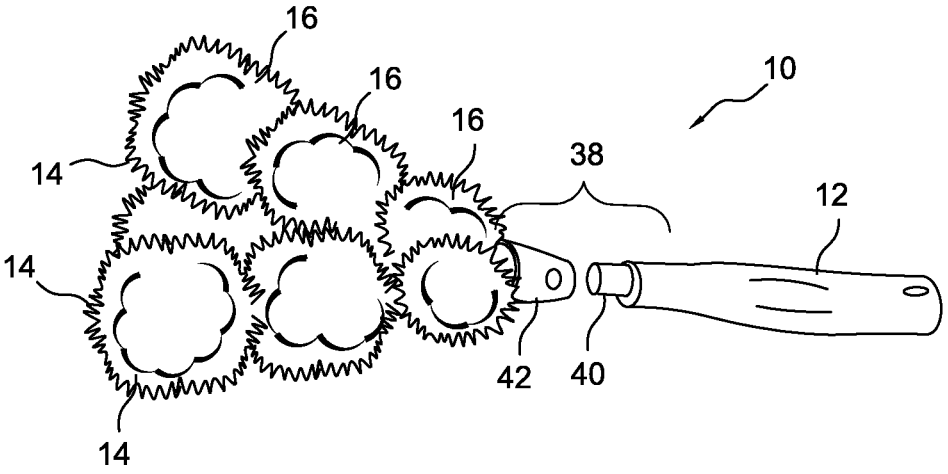
FIG. 16C is a perspective view of an exemplary embodiment of a dusting device according to the present disclosure having the spine of FIG. 16A or 16B.

In the embodiment shown in FIGS. 16A, 16B, and 16C, dusting device 10 is shown having cleaning members 14 with a spine 18 of a generally elongated straight shape. Here, a plurality of bundles 16 are secured to the same spine 18. In other words, each bundle 16 is shorter than spine 18 so that multiple bundles 16-1, 16-2, 16-3 can be secured to the spine adjacent to one another. Once bundles 16 are fluffed, it has been found that the bundles take a generally spherical appearance as shown.

Figure 17A:
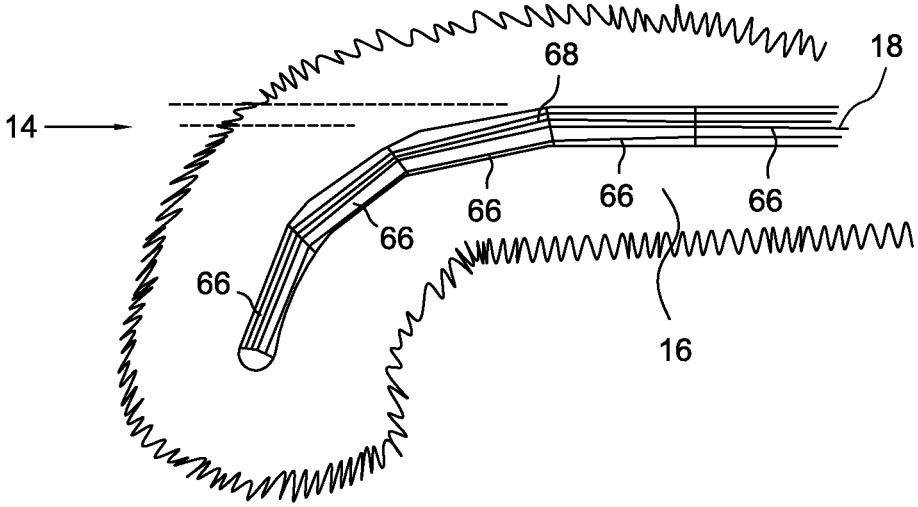
FIG. 17A illustrates still a further exemplary embodiment of a spine according to the present disclosure.
Figure 17B:
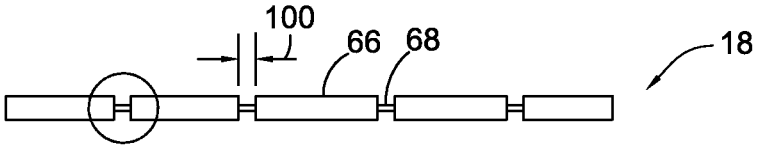
FIG. 17B through 17E illustrate expanded views of the spine of FIG. 17A.
Figure 17C:
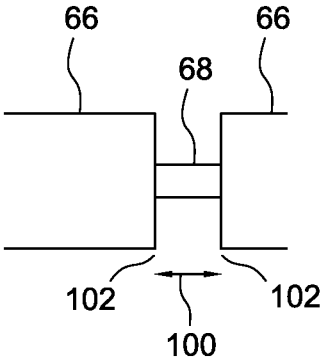
Figure 17D:
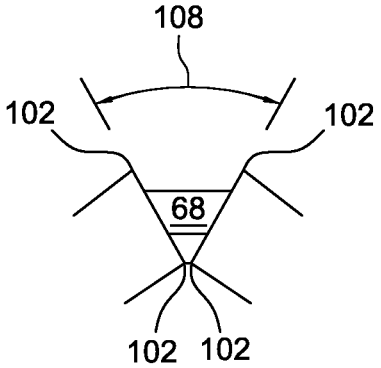

In the embodiment shown in FIG. 17A, dusting device 10 is shown having cleaning members 14 with a spine 18 of a generally elongated straight shape. Here, spine 18 is segmented into a plurality of segments 66, which allow the spine to move more flexibly and freely. Details of spine 18 having one or more segments 66 are explained in detail by simultaneous reference to FIGS. 17B through 17E. FIG. 17B illustrates segments 66 permanently bonded to cord 68. Such permanent bonding is achieved via overmolding the one or more segments 66 onto cord 68 so that spacing 100 between edges 102 of the segments is controlled to a predetermined spacing. Spine of FIG. 17B allows for controlled flexing of the spine with little to no flexural resistance. Rather, flexural resistance of spine 18 is controlled by the mechanical properties of cord 68. For example, if cord 68 is a string, spine 18 would provide little to no flexural resistance compared to a cord constructed out of metallic wire or elastic cord. Therefore, for some dusting applications, string like mechanical properties for cord 68 is preferred.

Controlled flexing can also be made possible by spacing 100. By reference to FIGS. 17C and D, each segment 66 has top and bottom edge 102. Edges 102 allows for limited flexing through an angle 108 when the adjacent edges 102 contact. When spacing 100 is increased, angle 108 is increased to allow more flexion. Conversely, when spacing 100 is decreased, angle 108 is decreased to allow less flexion.

Figure 17E:
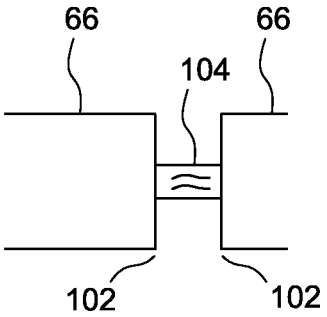

Referring now to FIG. 17E, cord 68 is shown as an elastomeric cord permanently bonded to segment 66. In this example, elastomeric cord 104 allows for additional flexure as compared to cord 68 via the stretching properties of elastomer cord 104.

Figure 17F:
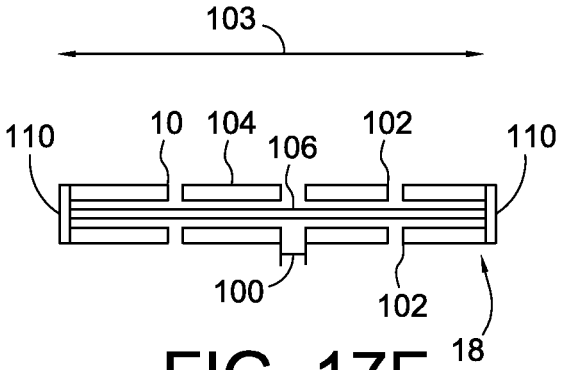
FIGS. 17F and 17G illustrate still further exemplary embodiment of a spine according to the present disclosure.
Figure 17G:
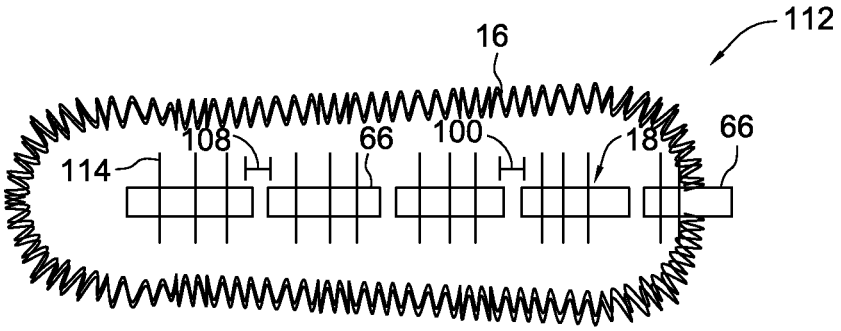

Referring now to FIG. 17F, spine 18 can includes one or more segments 104 that are constructed in hollow cylinders. Cord 106 has a length 103 and is inserted through each hollow portion of segments 104. Cord 106 further includes a pair of caps 110 on each end to control length 103 and the plurality of distances 100. In this example, all segments will move to a predetermined contact position thus limiting the flexing of the spine 18. In some embodiments, segments 66 can be separated from one another, but all joined to bundle 16. Cord 68 can be central to the segments, namely can pass through a hollow within the segments, or can be connected to an exterior of the segments.

Spine 18 having segments 66 can be bonded to bundle 16 in a variety of methods. The configurations as illustrated in FIGS. 17A through 17G can be bonded as detailed in the previous embodiments above. By reference to FIG. 17G, another configuration of spine 18 is shown having one or more segments 66. In this example, segments 66 are bonded directly to bundle 16 via a plurality of seams 114. In this example, the positions of segments 66 on bundle 16 create spacing 100, thus eliminating the requirement of a cord. The controlled flexing of spine 18 is similar as detailed above.

Figure 18:
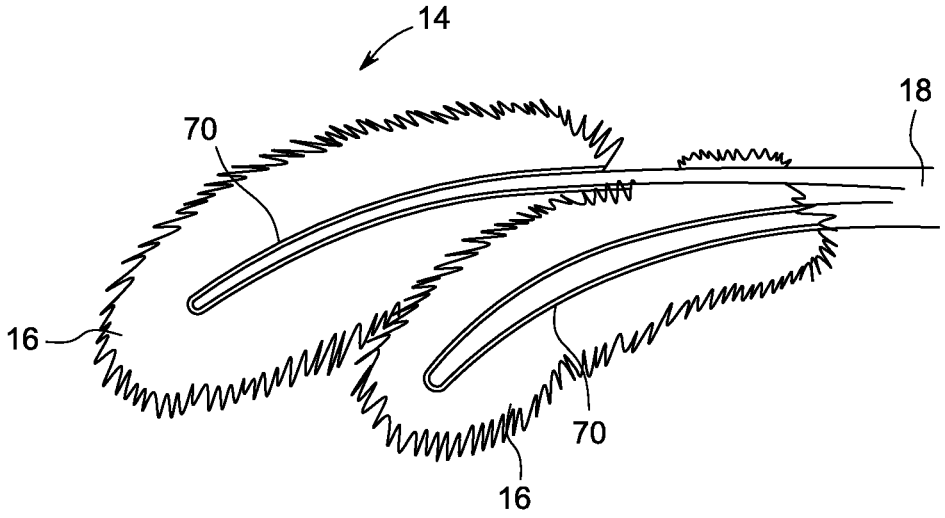
FIG. 18 illustrates still a further exemplary embodiment of a spine according to the present disclosure.

In the embodiment shown in FIG. 18, dusting device 10 is shown having cleaning members 14 with a spine 18 having a plurality of arms 70 each having a bundle 16 secured thereto.

Figure 19:
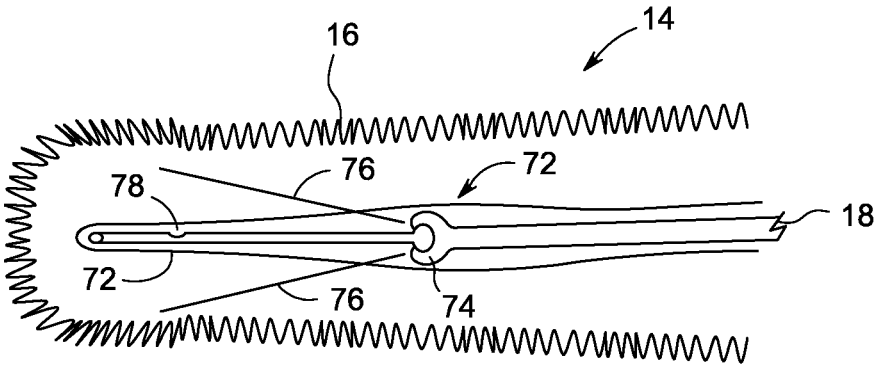
FIG. 19 illustrates still a further exemplary embodiment of a spine according to the present disclosure.

Referring now to FIG. 19, dusting device 10 is shown with another exemplary embodiment of an elongated cleaning member 14 with spine 18 having one or more hinge members 72 (two shown). Hinge members 72 can be any type of hinge member sufficient to enhance the flexibility of spine 18. In some embodiments, the seam securing bundle 16 to spine 18 can be discontinuous in the region of hinge member 72 to further enhance the flexibility of spine 18.

For example, hinge member 72 can be a ball-and-socket hinge 74 that provides a limited range of motion 76. Alternately, hinge member 72 can be a living hinge 78 defined in spine 18 by weakening the spine in one or more locations. The living hinge 78 can be provided by narrowing the thickness of the spine, adding one or more openings through the spine, or any other method to locally weaken the spine to bending. Of course, the present disclosure contemplates any other type of hinge member 72 is suitable to provide one or more regions of enhanced flexibility to spine 18.

Figure 20C:
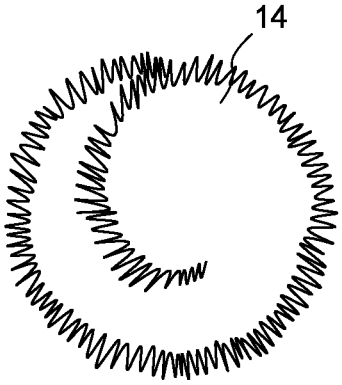
FIGS. 20A, 20B, and 20C are views of another exemplary embodiment of a dusting device according to the present disclosure.
Figure 20A:
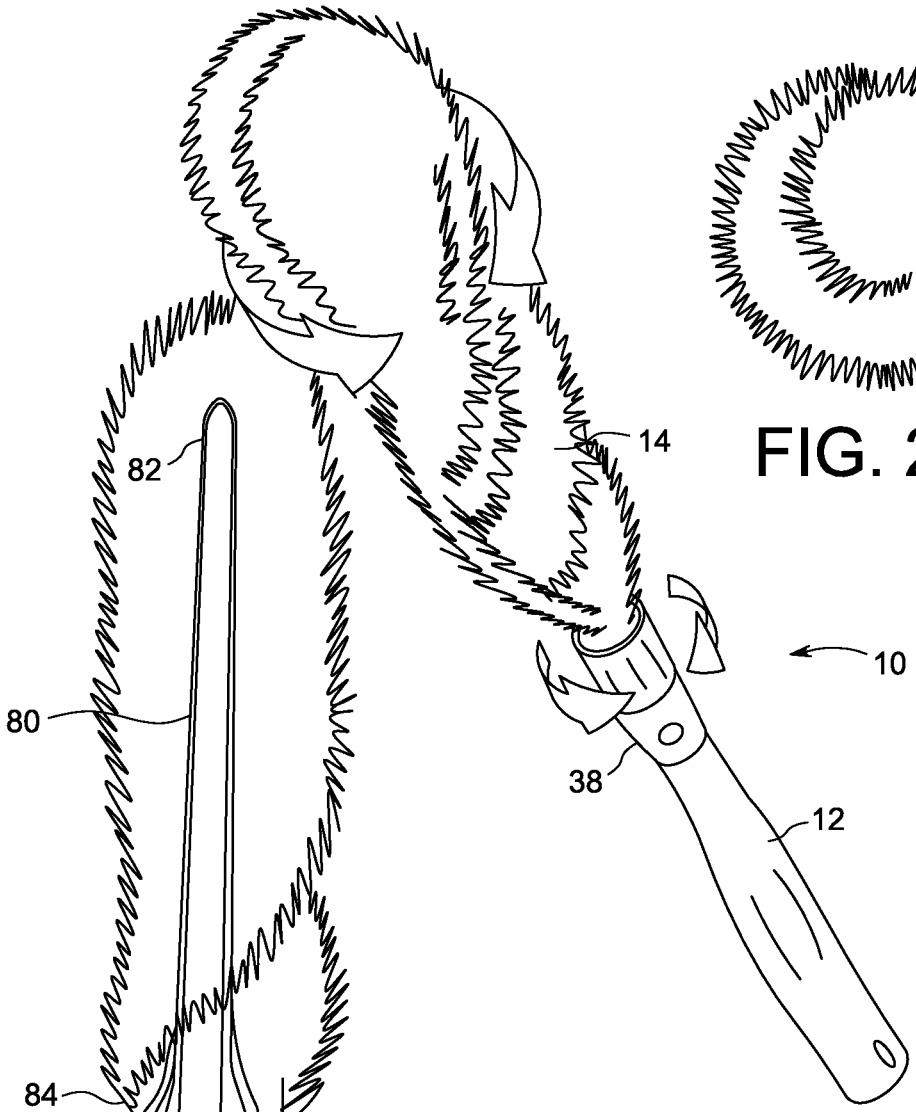
Figure 20B:
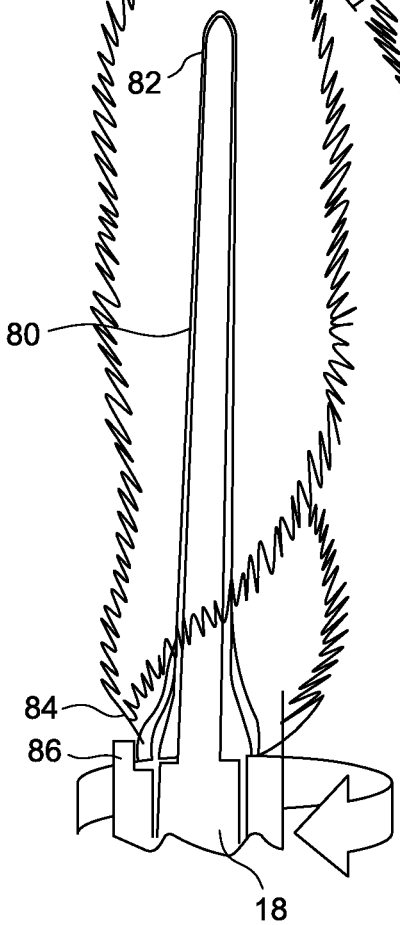

Referring now to FIGS. 20A, 20B, and 20C, another exemplary embodiment of dusting device 10 is shown. In this embodiment, bundle 16 is formed to include a pocket 80, in which spine 18 is received. At a terminal end 82 of spine 18, bundle 16 is secured to the spine by any desired method such as a sewn seam, a glued seam, a welded seam, press-fit, and any combinations thereof. Furthermore, at a proximal end 84 of spine 18, bundle 16 is secured to a collar 86 by any desired method such as a sewn seam, a glued seam, a welded seam, press-fit, and any combinations thereof. Collar 86 is rotatably disposed on spine 18 such that twisting of the collar twists bundle 16 about the spine.

Figure 21:
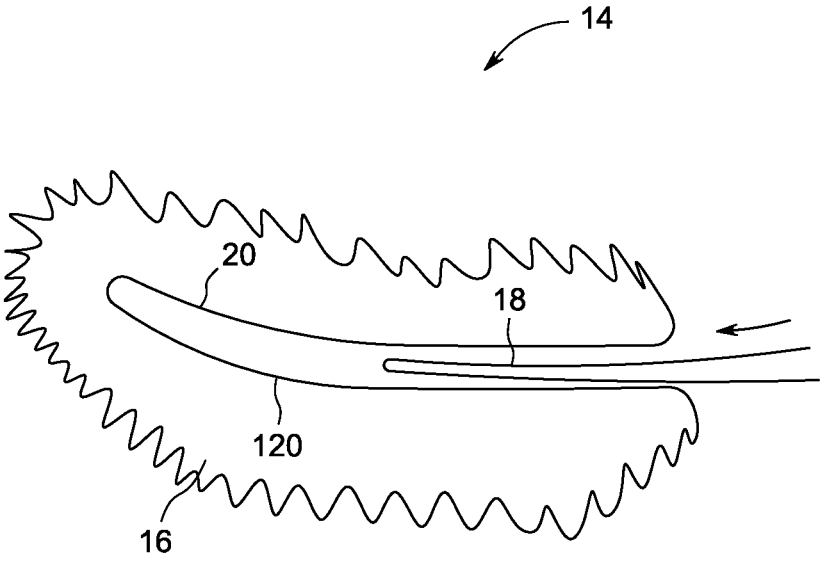
FIG. 21 illustrates another exemplary embodiment of a hand held dusting device according to the present disclosure.

It should be recognized that dusting device 10 is described above by way of example only as having bundle 16 secured directly to spine 18 by seam 30. However, it is also contemplated by the present disclosure for bundle 16 to be indirectly secured to spine 18 as desired. For example, and referring to FIG. 21, dusting device 10 includes seam 20 securing bundle 16 to a pocket or sleeve 120. In this embodiment, spine 18 can be inserted into sleeve 120 to a desired position and then the sleeve and spine can be permanently secured to one in any desired manner such as, but not limited to sewing, adhesive, welding, and any combinations thereof.

It should also be noted that the terms "first", "second", "third", "upper", "lower", and the like may be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. In addition, combinations of the different features can be combined to create different products. Therefore, it is intended that the present disclosure not be limited to the particular embodiment(s) disclosed as the best mode contemplated, but that the disclosure will include all embodiments falling within the scope of the appended claims.

What is claimed is:

1. A dusting device comprising, at least one cleaning member having a spine and a bundle of loose microfiber segments, the loose microfiber segments being secured only to one another to form said bundle, said bundle being secured to only one side of said spine by a seam, said spine providing a resilient flexibility to said at least one cleaning member such that said spine flexes as pressure is applied, but at least partially returns to an original shape upon removal of said pressure; and wherein said at least one cleaning member comprises a plurality of cleaning members.

2. The dusting device of claim 1, wherein said spine has a cross sectional shape selected from the group consisting of a substantially polygonal cross section, a circular cross section, an ovoid cross section, a star shaped cross-section having a core with a plurality of evenly spaced or unevenly spaced radially extending members, and any combinations thereof.

3. The dusting device of claim 1, wherein said loose microfiber segments of said bundle are directly secured to one another by another seam.

4. The dusting device of claim 1, further comprising a span control member slideably disposed over said plurality of cleaning members for movement between a first position and a second position.

5. The dusting device of claim 4, wherein said plurality of cleaning members are normally biased to a spread apart position when said span control member is in said first position, said span control member restraining said plurality of cleaning members when in said second position.

6. The dusting device of claim 1, wherein said seam is selected from the group consisting of a sewn seam, a glued seam, a welded seam, a woven seam, and any combinations thereof.

7. The dusting device of claim 1, wherein said loose microfiber segments comprise fibers having a denier of less than one.

8. The dusting device of claim 1, wherein said spine has a flat elongated shape.

9. The dusting device of claim 1, further comprising a plurality of microfiber bundles secured to said spine by said seam.

10. The dusting device of claim 1, wherein said plurality of cleaning members each comprises a plurality of spines integrally formed with one another.

11. The dusting device of claim 1, further comprising a handle connected to said at least one cleaning member.

12. The dusting device of claim 11, wherein said handle is releasably connected to said at least one cleaning member.

13. The dusting device of claim 11, wherein said spine is part of a spine assembly, said spine assembly comprising:

a plurality of said spines;

a base portion having said plurality of spines extending therefrom; and a pair of interlocking features releasably securing said base portion to said handle.

14. A dusting device comprising:

a plurality of elongated spines;

a base portion having said plurality of elongated spines extending therefrom; and a plurality of microfiber bundles, each bundle of said plurality of microfiber bundles comprising a plurality of microfiber segments secured to one another by a first seam, and each bundle of said plurality of microfiber bundles being secured to a different one of said plurality of elongated spines by a second seam, wherein said spines are resiliently flexible such that said spines flex as a pressure is applied, but at least partially return to an original shape upon removal of said pressure.

15. The dusting device of claim 14, further comprising a feature on said base portion to releasably secure said base portion to a handle.

16. The dusting device of claim 14, wherein each spine of said plurality of elongated spines has a cross sectional shape selected from the group consisting of a substantially polygonal cross section, a circular cross section, an ovoid cross section, a star shaped cross-section having a core with a plurality of evenly spaced or unevenly spaced radially extending members, and any combinations thereof.

17. The dusting device of claim 14, wherein said second seam is a sewn seam.

18. The dusting device of claim 14, wherein said microfiber bundle comprises a plurality of fibers having a denier of less than one.

19. The dusting device of claim 14, wherein each spine of said plurality of elongated spines comprises a material selected from the group consisting of nylon, polyethylene, polypropylene, thermoplastic elastomer (TPE), thermoplastic rubber (TPR), silicone rubber, hard durometer rubbers, foam, acetal, and any combinations thereof.

20. A dusting device comprising, at least one cleaning member having a spine and a bundle of loose microfiber segments, the loose microfiber segments being secured only to one another to form said bundle, said bundle being secured to only one side of said spine by a seam, said spine providing a resilient flexibility to said at least one cleaning member such that said spine flexes as pressure is applied, but at least partially returns to an original shape upon removal of said pressure; and wherein said spine comprises a material selected from the group consisting of nylon, polyethylene, polypropylene, thermoplastic elastomer (TPE), thermoplastic rubber (TPR), silicone rubber, hard durometer rubbers, foam, acetal, and any combinations thereof.

* * * * *